US011168563B1

(12) United States Patent
Sollami

(10) Patent No.: US 11,168,563 B1
(45) **Date of Patent: *Nov. 9, 2021**

(54) BIT HOLDER WITH DIFFERENTIAL INTERFERENCE

(71) Applicant: The Sollami Company, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 3 days.

This patent is subject to a terminal disclaimer.

(21) Appl. No.: 16/418,236

(22) Filed: May 21, 2019

Related U.S. Application Data

(63) Continuation-in-part of application No. 16/181,591, filed on Nov. 6, 2018, now Pat. No. 10,598,013, which is a continuation-in-part of application No. 14/512,581, filed on Oct. 13, 2014, now Pat. No. 10,072,501, said application No. 16/181,591 is a continuation-in-part of application No. 15/708,292, filed on Sep. 19, 2017, now Pat. No. 10,683,752, which is a continuation of application No. 14/628,482, filed on Feb. 23, 2015, now Pat. No. 9,879,531.

(60) Provisional application No. 61/891,683, filed on Oct. 16, 2013, provisional application No. 61/944,676, filed on Feb. 26, 2014.

(51) Int. Cl.
*E21C 35/18* (2006.01)
*E21C 35/197* (2006.01)

(52) U.S. Cl.
CPC ..... *E21C 35/18* (2013.01); *E21C 35/197* (2013.01); *E21C 35/188* (2020.05)

(58) Field of Classification Search
CPC ..... E21C 35/18; E21C 35/188; E21C 35/19; E21C 35/197
See application file for complete search history.

(56) References Cited

U.S. PATENT DOCUMENTS

| | | | |
|---|---|---|---|
| 2,382,947 | A | 7/1944 | Brozek |
| 2,810,567 | A | 10/1957 | Kirkham |
| 3,342,531 | A | 9/1967 | Krekeler |
| 3,342,532 | A | 9/1967 | Krekeler |
| 3,397,012 | A | 8/1968 | Krekeler |
| 3,476,438 | A | 11/1969 | Bower, Jr. |
| 3,519,309 | A | 7/1970 | Engle |
| 3,833,264 | A | 9/1974 | Elders |

(Continued)

FOREIGN PATENT DOCUMENTS

| | | |
|---|---|---|
| DE | 102004049710 | 4/2006 |
| DE | 102011079115 | 1/2013 |

(Continued)

*Primary Examiner* — Janine M Kreck
(74) *Attorney, Agent, or Firm* — Mercedes V. O'Connor; Rockman Videbeck & O'Connor

(57) ABSTRACT

A bit holder includes a larger bit shank bore and an enlarged upper shank segment or band that provides an interference fit between the top of the shank and the top of a bore of a base block when the bottom of a body of the bit holder seats on the top of the base block. The bit holder further includes a lower shank segment being cylindrical, inwardly tapered, and/or outwardly tapered, the lower shank segment having a differential taper than a corresponding lower bore portion of the base block.

26 Claims, 3 Drawing Sheets

(56) References Cited

U.S. PATENT DOCUMENTS 3,833,265 A 9/1974 Elders
3,865,437 A 2/1975 Crosby
4,084,856 A 4/1978 Emmerich
4,247,150 A 1/1981 Wrulich et al.
RE30,807 E 12/1981 Elders
4,310,939 A 1/1982 Iijima
4,453,775 A 6/1984 Clemmow
4,478,298 A 10/1984 Hake
4,489,986 A 12/1984 Dziak
4,525,178 A 6/1985 Hall
4,561,698 A 12/1985 Beebe
4,570,726 A 2/1986 Hall
4,604,106 A 8/1986 Hall
4,632,463 A 12/1986 Sterwerf, Jr.
4,694,918 A 9/1987 Hall
4,702,525 A 10/1987 Sollami
4,763,956 A 8/1988 Emmerich
4,811,801 A 3/1989 Salesky
4,818,027 A 4/1989 Simon
4,821,819 A 4/1989 Whysong
4,844,550 A 7/1989 Beebe
4,915,455 A 4/1990 O'Niell
4,944,559 A 7/1990 Sionett
5,067,775 A 11/1991 D'Angelo
5,088,797 A 2/1992 O'Neill
5,098,167 A 3/1992 Latham
5,159,233 A 10/1992 Sponseller
5,161,627 A 11/1992 Burkett
5,273,343 A 12/1993 Ojanen
5,287,937 A 2/1994 Sollami
5,302,005 A 4/1994 O'Neill
5,303,984 A 4/1994 Ojanen
5,352,079 A 10/1994 Croskey
5,370,448 A 12/1994 Sterwerf, Jr.
5,374,111 A * 12/1994 Den Besten ..... E21C 35/19 299/106
5,415,462 A 5/1995 Massa
5,417,475 A 5/1995 Graham et al.
5,458,210 A 10/1995 Sollami
5,484,191 A 1/1996 Sollami
5,492,188 A 2/1996 Smith et al.
5,551,760 A 9/1996 Sollami
5,607,206 A 3/1997 Siddle
5,628,549 A 5/1997 Ritchey
5,720,528 A 2/1998 Ritchey
5,725,283 A 3/1998 O'Neill
5,823,632 A 10/1998 Burkett
5,924,501 A 7/1999 Tibbitts
5,931,542 A 8/1999 Britzke
5,934,854 A 8/1999 Krautkremer et al.
5,992,405 A 11/1999 Sollami
D420,013 S 2/2000 Warren
6,019,434 A 2/2000 Emmerich
6,102,486 A 8/2000 Briese
6,176,552 B1 * 1/2001 Topka, Jr. ..... E21C 35/18 299/104
6,196,340 B1 3/2001 Jensen et al.
6,199,451 B1 3/2001 Sollami
6,250,535 B1 6/2001 Sollami
6,331,035 B1 12/2001 Montgomery, Jr.
6,341,823 B1 1/2002 Sollami
6,357,832 B1 3/2002 Sollami
6,371,567 B1 * 4/2002 Sollami ..... E21C 35/197 299/104
6,382,733 B1 5/2002 Parrott
6,428,110 B1 8/2002 Ritchey et al.
6,508,516 B1 1/2003 Kammerer
D471,211 S 3/2003 Sollami
6,585,326 B2 7/2003 Sollami
6,685,273 B1 2/2004 Sollami
6,692,083 B2 2/2004 Latham
D488,170 S 4/2004 Sollami
6,733,087 B2 5/2004 Hall
6,739,327 B2 5/2004 Sollami
6,786,557 B2 9/2004 Montgomery
6,824,225 B2 11/2004 Stiffer
6,846,045 B2 1/2005 Sollami
6,854,810 B2 2/2005 Montgomery
6,866,343 B2 3/2005 Holl et al.
6,968,912 B2 11/2005 Sollami
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,971 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall
7,571,782 B2 8/2009 Hall
7,575,425 B2 8/2009 Hall
7,588,102 B2 9/2009 Hall
7,594,703 B2 9/2009 Hall
7,600,544 B1 10/2009 Sollami
7,600,823 B2 10/2009 Hall
7,628,233 B1 12/2009 Hall
7,635,168 B2 12/2009 Hall
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
7,992,944 B2 8/2011 Hall
7,992,945 B2 8/2011 Hall
7,997,660 B2 8/2011 Monyak et al.
7,997,661 B2 8/2011 Hall
8,007,049 B2 8/2011 Fader
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 * 6/2012 Hall ..... E21C 35/1933 299/102
8,215,420 B2 7/2012 Hall
8,292,372 B2 10/2012 Hall
8,414,085 B2 4/2013 Hall
8,449,039 B2 5/2013 Hall
8,485,609 B2 7/2013 Hall

(56) References Cited

U.S. PATENT DOCUMENTS

| | | | | |
|---|---|---|---|---|
| 8,500,209 | B2 | 8/2013 | Hall | |
| 8,540,320 | B2 * | 9/2013 | Sollami | E21C 35/197 299/102 |
| RE44,690 | E | 1/2014 | Sollami | |
| 8,622,482 | B2 | 1/2014 | Sollami | |
| 8,622,483 | B2 | 1/2014 | Sollami | |
| 8,646,848 | B2 | 2/2014 | Hall | |
| 8,728,382 | B2 | 5/2014 | Hall | |
| 8,740,314 | B2 | 6/2014 | O'Neill | |
| 9,004,610 | B2 | 4/2015 | Erdmann et al. | |
| 9,028,008 | B1 | 5/2015 | Bookhamer | |
| 9,039,099 | B2 | 5/2015 | Sollami | |
| 9,316,061 | B2 | 4/2016 | Hall | |
| 9,518,464 | B2 | 12/2016 | Sollami | |
| 9,879,531 | B2 * | 1/2018 | Sollami | E21C 35/18 |
| 9,909,416 | B1 | 3/2018 | Sollami | |
| 9,976,418 | B2 | 5/2018 | Sollami | |
| 9,988,903 | B2 | 6/2018 | Sollami | |
| 10,072,501 | B2 | 9/2018 | Sollami | |
| 10,105,870 | B1 | 10/2018 | Sollami | |
| 10,107,097 | B1 | 10/2018 | Sollami | |
| 10,107,098 | B2 | 10/2018 | Sollami | |
| 10,180,065 | B1 | 1/2019 | Sollami | |
| 10,260,342 | B1 | 4/2019 | Sollami | |
| 10,323,515 | B1 | 6/2019 | Sollami | |
| 10,337,324 | B2 * | 7/2019 | Sollami | E21C 35/19 |
| 10,370,966 | B1 | 8/2019 | Sollami | |
| 10,385,689 | B1 | 8/2019 | Sollami | |
| 10,415,386 | B1 | 9/2019 | Sollami | |
| 10,502,056 | B2 * | 12/2019 | Sollami | E21C 35/19 |
| 10,577,931 | B2 * | 3/2020 | Sollami | E21C 35/18 |
| 10,598,013 | B2 * | 3/2020 | Sollami | E21C 35/18 |
| 2002/0063467 | A1 | 5/2002 | Taitt | |
| 2002/0074850 | A1 | 6/2002 | Montgomery, Jr. | |
| 2002/0074851 | A1 | 6/2002 | Montgomery, Jr. | |
| 2002/0109395 | A1 | 8/2002 | Sollami | |
| 2002/0167216 | A1 | 11/2002 | Sollami | |
| 2002/0192025 | A1 | 12/2002 | Johnson | |
| 2003/0015907 | A1 | 1/2003 | Sollami | |
| 2003/0047985 | A1 | 3/2003 | Stiffler | |
| 2003/0052530 | A1 | 3/2003 | Sollami | |
| 2003/0122414 | A1 | 7/2003 | Sollami | |
| 2003/0209366 | A1 | 11/2003 | McAlvain | |
| 2004/0004389 | A1 | 1/2004 | Latham | |
| 2004/0174065 | A1 | 9/2004 | Sollami | |
| 2005/0212345 | A1 | 9/2005 | Sleep et al. | |
| 2006/0071538 | A1 | 4/2006 | Sollami | |
| 2006/0186724 | A1 | 8/2006 | Stehney | |
| 2006/0261663 | A1 | 11/2006 | Sollami | |
| 2007/0013224 | A1 | 1/2007 | Stehney | |
| 2007/0040442 | A1 | 2/2007 | Weaver | |
| 2007/0052279 | A1 | 3/2007 | Sollami | |
| 2008/0035386 | A1 | 2/2008 | Hall et al. | |
| 2008/0036276 | A1 | 2/2008 | Hall et al. | |
| 2008/0036283 | A1 | 2/2008 | Hall et al. | |
| 2008/0100124 | A1 | 5/2008 | Hall et al. | |
| 2008/0145686 | A1 | 6/2008 | Mirchandani | |
| 2008/0164747 | A1 | 7/2008 | Weaver et al. | |
| 2008/0284234 | A1 | 11/2008 | Hall et al. | |
| 2009/0146491 | A1 | 6/2009 | Fader et al. | |
| 2009/0160238 | A1 | 6/2009 | Hall et al. | |
| 2009/0256413 | A1 | 10/2009 | Majagi | |
| 2009/0261646 | A1 | 10/2009 | Ritchie et al. | |
| 2010/0045094 | A1 | 2/2010 | Sollami | |
| 2010/0244545 | A1 | 9/2010 | Hall | |
| 2010/0253130 | A1 * | 10/2010 | Sollami | E21C 35/197 299/113 |
| 2010/0320003 | A1 | 12/2010 | Sollami | |
| 2010/0320829 | A1 | 12/2010 | Sollami | |
| 2011/0006588 | A1 | 1/2011 | Monyak et al. | |
| 2011/0089747 | A1 | 4/2011 | Helsel | |
| 2011/0175430 | A1 | 7/2011 | Heiderich et al. | |
| 2011/0204703 | A1 | 8/2011 | Sollami | |
| 2011/0254350 | A1 | 10/2011 | Hall | |
| 2012/0001475 | A1 | 1/2012 | Dubay et al. | |
| 2012/0027514 | A1 | 2/2012 | Hall | |
| 2012/0056465 | A1 | 3/2012 | Gerer et al. | |
| 2012/0068527 | A1 | 3/2012 | Erdmann | |
| 2012/0104830 | A1 | 5/2012 | Monyak et al. | |
| 2012/0181845 | A1 | 7/2012 | Sollami | |
| 2012/0242136 | A1 | 9/2012 | Ojanen | |
| 2012/0248663 | A1 | 10/2012 | Hall | |
| 2012/0261977 | A1 | 10/2012 | Hall | |
| 2012/0280559 | A1 | 11/2012 | Watson | |
| 2012/0286559 | A1 | 11/2012 | Sollami | |
| 2012/0319454 | A1 | 12/2012 | Swope | |
| 2013/0169023 | A1 | 7/2013 | Monyak | |
| 2013/0181501 | A1 | 7/2013 | Hall et al. | |
| 2013/0199693 | A1 | 8/2013 | Tank et al. | |
| 2013/0307316 | A1 | 11/2013 | Roetsch et al. | |
| 2014/0035346 | A1 | 2/2014 | Fundakowski et al. | |
| 2014/0110991 | A1 | 4/2014 | Sollami | |
| 2014/0232172 | A1 | 8/2014 | Roth et al. | |
| 2014/0262541 | A1 | 9/2014 | Parsana et al. | |
| 2014/0326516 | A1 | 11/2014 | Haugvaldstad | |
| 2015/0028656 | A1 | 1/2015 | Sollami | |
| 2015/0035343 | A1 | 2/2015 | Ojanen | |
| 2015/0137579 | A1 | 5/2015 | Lachmann et al. | |
| 2015/0198040 | A1 | 7/2015 | Voitic et al. | |
| 2015/0240634 | A1 | 8/2015 | Sollami | |
| 2015/0285074 | A1 | 10/2015 | Sollami | |
| 2015/0292325 | A1 | 10/2015 | Sollami | |
| 2015/0300166 | A1 | 10/2015 | Ries et al. | |
| 2015/0308488 | A1 | 10/2015 | Kahl | |
| 2015/0315910 | A1 | 11/2015 | Sollami | |
| 2015/0354285 | A1 | 12/2015 | Hall | |
| 2016/0102550 | A1 | 4/2016 | Paros et al. | |
| 2016/0194956 | A1 | 7/2016 | Sollami | |
| 2016/0229084 | A1 | 8/2016 | Lehnert | |
| 2016/0237818 | A1 | 8/2016 | Weber | |
| 2017/0089198 | A1 | 3/2017 | Sollami | |
| 2017/0101867 | A1 | 4/2017 | Hall et al. | |

FOREIGN PATENT DOCUMENTS

| | | |
|---|---|---|
| DE | 202012100353 | 6/2013 |
| DE | 102015121953 | 7/2016 |
| DE | 102016118658 | 3/2017 |
| EP | 3214261 | 9/2017 |
| GB | 1114156 | 5/1968 |
| GB | 1218308 | 1/1971 |
| GB | 2483157 | 2/2012 |
| GB | 2534370 | 7/2016 |
| WO | 2008105915 A2 | 9/2008 |
| WO | 2008105915 A3 | 9/2008 |
| WO | 2009006612 | 1/2009 |

* cited by examiner

DETAIL A

SECTION B-B

BIT HOLDER WITH DIFFERENTIAL INTERFERENCE

CROSS-REFERENCE TO RELATED APPLICATIONS

This application claims priority to and is a continuation-in-part of U.S. Non-provisional application Ser. No. 16/181,591, filed Nov. 6, 2018, claims priority to and is a continuation-in-part of U.S. Provisional Application No. 61/944,676, filed Feb. 26, 2014, claims priority to and is a continuation-in-part of U.S. Non-provisional application Ser. No. 14/628,482, filed Feb. 23, 2015, now U.S. Pat. No. 9,879,531, issued Jan. 30, 2018, claims priority to and is a continuation-in-part of U.S. Non-provisional application Ser. No. 15/708,292, filed Sep. 19, 2017, claims priority to and is a continuation-in-part of U.S. Provisional Application No. 61/891,683, filed Oct. 16, 2013, and claims priority to and is a continuation-in-part of U.S. Non-provisional application Ser. No. 14/512,581, filed Oct. 13, 2014, now U.S. Pat. No. 10,072,501, issued Sep. 11, 2018, to the extent allowed by law and the contents of which are incorporated herein by reference in their entireties.

TECHNICAL FIELD

This disclosure relates to bit assemblies for road milling, mining and trenching machines and, more particularly, to improved bit holder blocks, bit holders and bits for use in road milling machines.

BACKGROUND

Road mining, trenching, and milling equipment utilizes bits and/or picks traditionally set in a bit assembly. Bit assemblies can include a bit and/or pick retained within a bore in a base bock. Bit assemblies can also include a bit and/or pick retained by a bit holder and the bit holder retained within a bore in a bit holder block, hereinafter referred to as a base block. A plurality of the bit assemblies are mounted on an outside surface of a rotatable, cylindrical drum, typically in a herringbone, V-shape, or spiral configuration. A plurality of the bit assemblies can also be mounted on an endless chain and plate configuration or on an outer surface of a continuous chain. Bit bodies can include a generally conical, parabolic, and/or angular cutting tip that is mounted in a recess in a forward body portion of the bit body. The combinations of bit assemblies have been utilized to remove material from the terra firma, such as degrading the surface of the earth, minerals, cement, concrete, macadam or asphalt pavement. Individual bits and/or picks, bit holders, and base blocks may wear down or break over time due to the harsh road and trenching degrading environment. The shank of the bit holder is generally cylindrical in shape, hollow with a thick generally annular side wall and slotted on a distal portion of that side wall in an axially inward direction allowing for radial compression when inserted in the bore of the base block, having sufficient radial force between that shank and the bore to maintain the bit holder in the base block during use.

SUMMARY

This disclosure relates generally to a bit holder for mining, trenching, and/or milling equipment. One implementation of the teachings herein is a bit holder including a body portion including a bottom; a generally cylindrical hollow shank axially extending from the bottom of the body portion, the shank comprising: a slot extending generally axially from a distal end of the shank; and a first segment adjacent the distal end of the shank, the first segment including one of an inwardly tapered outer surface, an outwardly tapered outer surface, and a cylindrical outer surface.

These and other aspects of the present disclosure are disclosed in the following detailed description of the embodiments, the appended claims and the accompanying figures.

BRIEF DESCRIPTION OF THE DRAWINGS

The various features, advantages, and other uses of the apparatus will become more apparent by referring to the following detailed description and drawings, wherein like reference numerals refer to like parts throughout the several views. It is emphasized that, according to common practice, the various features of the drawings are not to-scale. On the contrary, the dimensions of the various features are arbitrarily expanded or reduced for clarity.

DETAILED DESCRIPTION

Figures 1, 2:
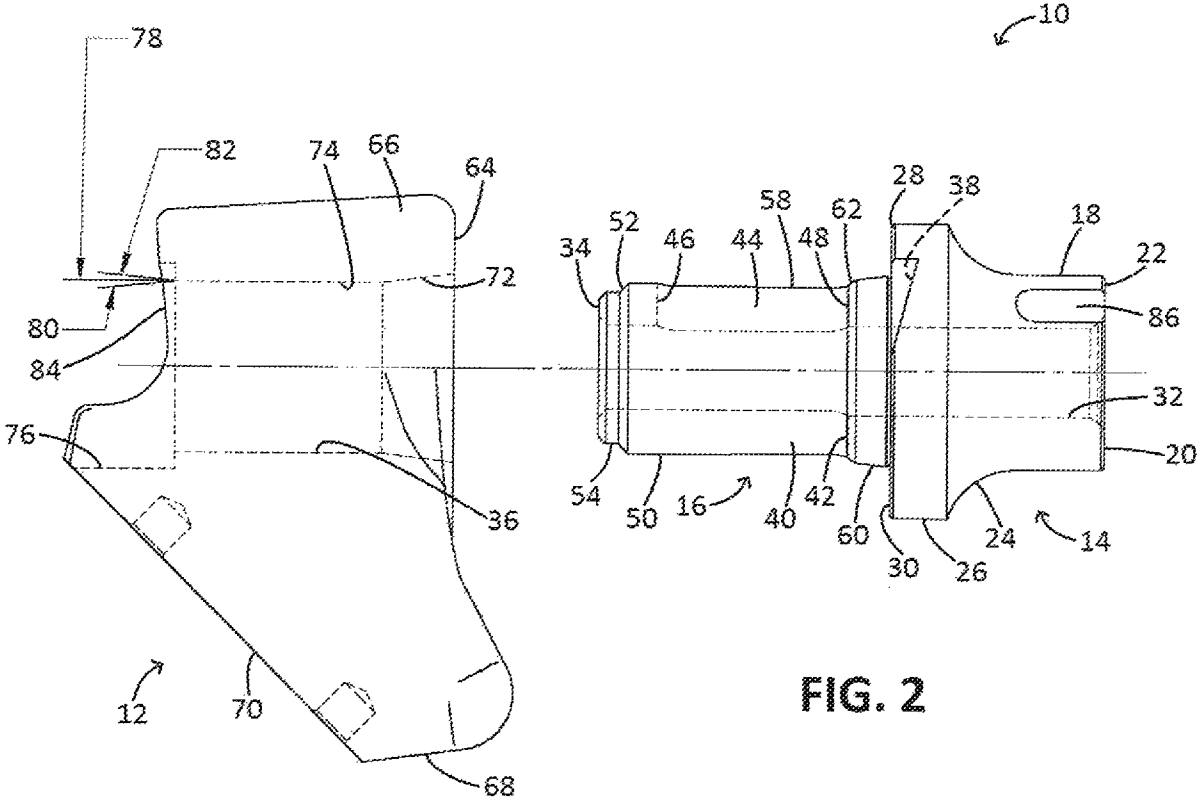
FIG. 2 PRIOR ART
FIG. 1 is a side elevation view of a base block, showing invisible internal elements in dotted lines, of the prior art.
FIG. 2 is a side elevation view of a first embodiment of a bit holder, showing invisible internal elements in dotted lines, in accordance with implementations of this disclosure.

Road mining, trenching, and milling equipment utilizes bits and/or picks traditionally set in a bit assembly. Bit assemblies can include a bit and/or pick retained within a bore in a base bock. Bit assemblies can also include a bit and/or pick retained by a bit holder and the bit holder retained within a bore in a bit holder block, hereinafter referred to as a base block. A plurality of the bit assemblies are mounted on an outside surface of a rotatable, cylindrical drum, typically in a herringbone, V-shape, or spiral configuration. A plurality of the bit assemblies can also be mounted on an endless chain and plate configuration or on an outer surface of a continuous chain. Bit bodies can include a generally conical, parabolic, and/or angular cutting tip that is mounted in a recess in a forward body portion of the bit body. The combinations of bit assemblies have been utilized to remove material from the terra firma, such as degrading the surface of the earth, minerals, cement, concrete, macadam or asphalt pavement. Individual bits and/or picks, bit holders, and base blocks may wear down or break over time due to the harsh road and trenching degrading environment. The shank of the bit holder is generally cylindrical in shape, hollow with a thick generally annular side wall and slotted on a distal portion of that side wall in an axially inward direction allowing for radial compression when inserted in the bore of the base block, having sufficient radial force between that shank and the bore to maintain the bit holder in the base block during use. the bit holder shank of the present disclosure is capable of operating in many base block bore configurations of the base block.

The base block bore may comprise many different configurations. In one configuration, the base block bore would be tapered in a non-locking taper configuration approximating one degree of taper per side and the shank of the bit holder would likewise be tapered along a portion of its length such that the insertion of the bit holder shank in the base block bore need only be forced approximately ½ to 1¼ inch to mount the bit holder shank in the base block bore. In another configuration, the base block bore would be configured with either near a perfectly cylindrical base block bore and a cylindrical distal end of the slotted bit holder shank. Such a configuration requires forcing the bit holder shank into the base block bore a distance between of about two inches to retain the bit assembly together during use. In yet another configuration, the base block bore comprises, at approximately its outer ½ axial length, a frustoconical shape taper approximating 5.5 degrees per side with the inner portion of the base block bore's axial length being cylindrical in shape. The distal end half of the bit holder shank is slotted in a configuration useful with this type of base block bore. The bit holder shank of the present disclosure is capable of operating in the multiple base block bore configurations.

Referring to FIGS. 1-7, a first embodiment of a bit holder 10 in accordance with the present disclosure and a base block 12 of the prior art are shown. The bit holder 10 includes a body 14 and a generally cylindrical hollow shank 16 (FIGS. 2 and 7) axially depending from a bottom of the body 14. The bit holder body 14 includes a generally cylindrical or annular upper body portion 18 depending from a flat annular surface 20 at a forward end 22 of the bit holder 10. The flat annular surface 20 includes a generally cylindrical outline and is typically identical to or very similar to the major diameter of a bit (not shown), and/or bit washer (not shown), which may be mounted on the flat annular surface 20 and in a central bore 32 of the bit holder 10 extending axially through the bit holder body 14 and shank 16 of the bit holder 10. A pair of notches 86 (FIGS. 2, 3, and 5), 88 (not shown) are formed into the bit holder body 14 and extend from the flat annular top surface 20. The notches 86, 88 provide access and leverage for a tool to extract, or knock out, a bit from the bit holder body 14.

A mediate body portion 24 subjacent the upper body portion 18 generally slopes axially and radially outwardly to a radially extending generally cylindrical tire portion 26 which is the widest radially extending portion of the bit holder 10. In this illustrated embodiment, the mediate body portion 24 has a concave side surface. In other embodiments, the side surface of the mediate body portion can have other shapes, such as an arcuate shape, a convex shape, or a conical shape and is generally shaped to deflect material outwardly from the bit holder 10 as it is separated by the bit and moves axially and outwardly along the bit, bit holder 10, and base block 12 bodies. A chamfer 28 (FIGS. 2-4) axially extends from the tire portion 26 to a generally annular radially extending back flange 30 (FIGS. 2-4) that denotes the base or bottom of the body 14 of the bit holder 10. This bottom portion is adapted to fit contiguously with a top surface 64 of a bit holder receiving portion 66 of the base block 12. The contiguous fit allows for fewer critical surfaces between the bit holder 10 and the base block 12 than if the tire portion 26 was spatially related to the top surface 64 of the base block 12 as the shank 16 is fully mounted in a bore 36 (FIGS. 1 and 7) of the base block 12. The central bore 32 of the bit holder 10 longitudinally and axially extends from the forward end 22 of the body 14 of the bit holder 10 to a distal end 34 of the shank 16 of the bit holder 10. This allows the generally C-shaped annular side wall of the shank 16 to radially contract when the shank 16 is mounted in the bore 36 of the base block 12.

Figure 3:
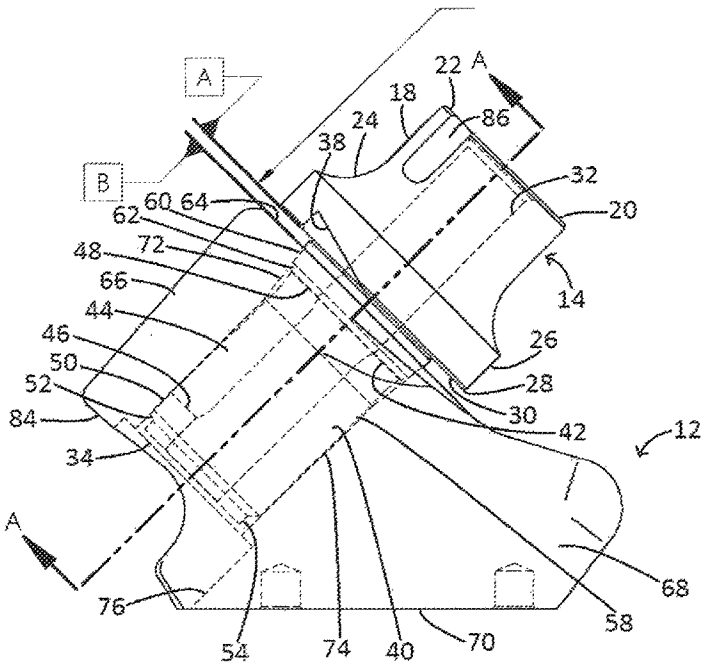
FIG. 3 is a side elevation view of the first embodiment of the bit holder shown mounted in the base block of the prior art, showing invisible internal elements in dotted lines, in accordance with implementations of this disclosure.
Figure 4:
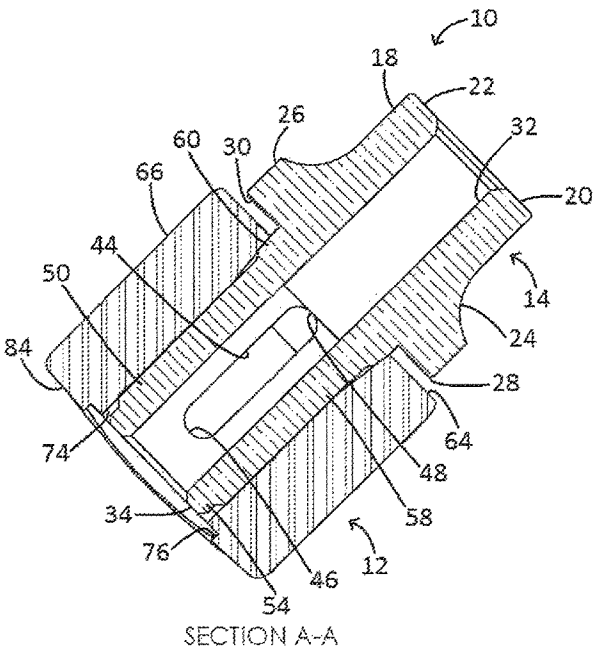
FIG. 4 is a cross-sectional view of the first embodiment of the bit holder shown mounted in the base block of the prior art, taken along Line A-A of FIG. 3, in accordance with implementations of this disclosure.
Figure 7:
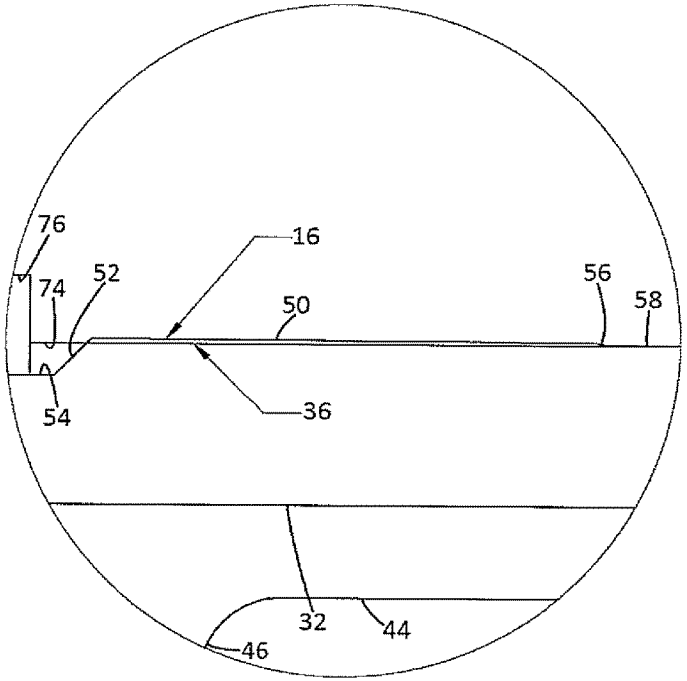
FIG. 7 is a detail view of Detail A of FIG. 6 of the first embodiment of the bit holder in accordance with implementations of this disclosure.

The generally annular flange 30 includes a pair of horizontal slots or tapered undercuts 38 (FIGS. 2, 3, and 5), 39 (not shown) generally perpendicular to the longitudinal axis of the bit holder 10, one on either side of the generally annular flange 30. The horizontal slots 38, 39 are configured to receive a pair of bifurcated fork tines that may be inserted, for removal of the bit holder 10 from the base block 12, between the base of the body 14 of the bit holder 10 and the base block 12 into which the shank 16 of the bit holder 10 is inserted and retained by outward radial force in use. The horizontal slots 38, 39 each include a flat vertical inside surface parallel with each other and a flat tapered top or roof surface. The outside edge of the flat tapered top or roof surface of each horizontal slot 38, 39 is arcuate in shape and follow the periphery of the tire portion 26. The interior border, or declining terminus, of each horizontal slot 38, 39 does not extend to a plane through the centerline of the bit holder 10, as shown in FIG. 3. The interior of the generally annular flange 30 and the top of the shank 16 also include a U-shaped undercut or rounded junction 68 between the top portion 60 of the shank 16 and the generally annular back flange 30 of the body 14 of the bit holder 10. The U-shaped undercut or rounded junction 68 provides a stress relieving portion between the bit holder body 14 and the shank 16 of the bit holder 10, avoiding sharp corners and/or edges and which may provide an area for stress cracks to begin.

The shank 16 includes an elongate first slot 40 (FIGS. 2 and 3) extending from the generally annular distal end 34 of the shank 16 axially upward or forward to an upper termination 42 (FIGS. 2 and 3) adjacent the upper or forward end of the shank 16. In this illustrated embodiment, the shank 16 also includes an optional internally oriented second slot 44 located approximately 180 degrees around the annular shank 16 from the first slot 40. This second slot 44 is parallel to the first slot 40 and is an internal slot having a rearward semicircular termination 46 inwardly adjacent to the distal end 34 of the shank 16 and a forward semicircular termination 48 generally coinciding longitudinally and axially with the upper termination 42 of the first slot 40.

Figure 5:
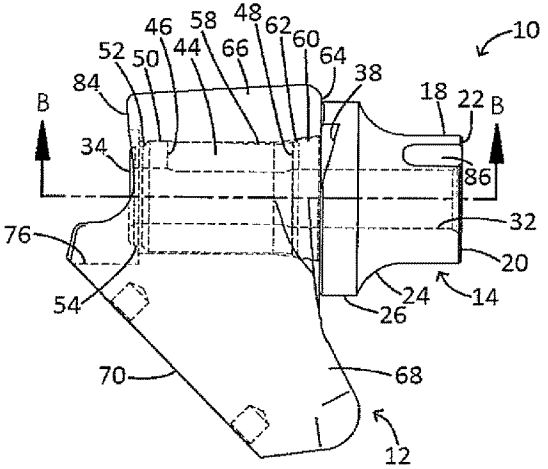
FIG. 5 is a side elevation view of the first embodiment of the bit holder shown mounted in the base block of the prior art, showing invisible internal elements in dotted lines, in accordance with implementations of this disclosure.

The shank 16 includes a lower or first portion 50 running axially from a stepped shoulder 52 adjacent the distal end 34 of the shank 16. The stepped shoulder 52 is disposed between the lower portion 50 and a decreased diameter distal portion 54. The decreased diameter distal portion 54 depends from the stepped shoulder 52 and, as shown in FIG. 5, may be positioned to extend slightly outwardly of a rear 84 of the bit holder mounting portion 66, approximately ¼ to ⅝ inch in this illustrated embodiment, when the bit holder 10 is fully mounted in the bore 36 of the base block 12 and may provide a means for driving the bit holder 10 partially from the base block 12 when desired. The distal portion 54 is generally C-shaped when viewed from the distal end 34 of the bit holder 10.

A diameter of the stepped shoulder 52 increases, or steps up, as it axially extends from the distal portion 54 to the lower portion 50. The first portion 50 runs upwardly or axially from the stepped shoulder 52 of the shank 16 and terminates generally mid slot 40 longitudinally. The lower portion 50, in this illustrated embodiment, is between 0.005 and 0.050 inches larger than the corresponding base block bore 36 at the axial location corresponding to same when the bit holder 10 is slidably inserted in the bore 36 of the base block 12. The lower portion 50 collapses radially, when the bit holder shank 16 is inserted in the base block bore 36, elastically to an extent that provides sufficient radial force to maintain the shank 16 of the bit holder 10 in the bore 36 of the base block 12 during use. The interference may be termed a differential interference with the base block bore 36 as it increases as one moves from the top of the lower portion 50 to the bottom of the lower portion 50. This interference is increased until it creates a radial force between 5,000 and 30,000 pounds radial force which maintains the bit holder 10 in the bore 36 of the base block 12 during the rugged use to which the bit assembly is subjected.

Figure 6:
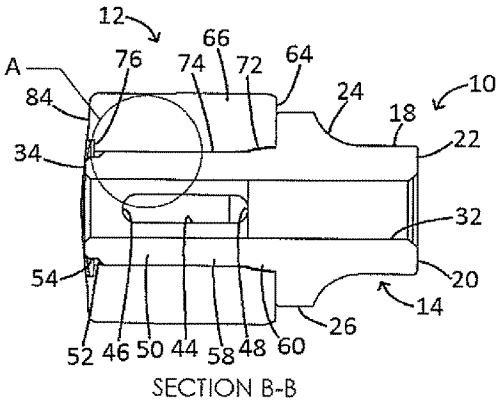
FIG. 6 is a cross-sectional view of the first embodiment of the bit holder shown mounted in the base block of the prior art, taken along Line B-B of FIG. 5, in accordance with implementations of this disclosure.

The shank 16 also includes an annular shoulder 56 (FIG. 7) separating the lower portion 50 from a decreased diameter mediate or second portion 58 which extends from the shoulder 56 generally adjacent to the top of the shank 16 or forward terminations 42, 48 of slots 40, 44, respectively, and may be tapered or cylindrical in axial dimension. A diameter of the annular shoulder 56 decreases, or steps down, as it axially extends from the lower portion 50 to the mediate portion 58. An upper or top increased diameter tapered portion 60 of the shank 16 extends from a position adjacent the top or upper terminations 42, 48 of slots 40, 44, respectively, towards the generally annular back flange 30 of the body 14 of the bit holder 12. In this illustrated embodiment, the outer diameter of the top tapered portion 60 is 0.000 to 0.005 inch larger than the corresponding inner diameter of the base block bore 72. As shown in FIGS. 5 and 6, this interference fit is provided with the annular back flange 30 of the bit holder body 14 resting on the top flat surface 64 of the base block 12 when the bit holder 10 is mounted in the base block bores 36, 72, 74.

In this illustrated embodiment, the top tapered portion 60 is tapered towards the axis of the bit holder 10 as it extends axially from the back flange 30 to a tapered portion 62 (FIGS. 2, 3, and 5) of the shank 16. The tapered portion 62 axially extends from the upper portion 60 to the mediate portion 58 of the shank 16. In this illustrated embodiment, the top or upper terminations 42, 48 of slots 40, 44, respectively, are disposed adjacent to the tapered portion 62. In other embodiments, the top or upper terminations 42, 48 of slots 40, 44, respectively, may be located anywhere axially along the length of the mediate portion 58. In other embodiments, the shank 16 may comprise different configurations, for example, the lower portion 50 and/or the mediate portion 58 of the shank 16 may comprise a generally cylindrical shape, a slight draw angle, or a slight draft angle.

The base block 12 includes a base 68 (FIGS. 1, 3, and 5) and the bit holder receiving or mounting portion 66 integrally extending from the base 68. The base 68 includes a bottom 70 (FIGS. 1, 3, and 5) that can be flat or slightly concave to fit a drum or additional mounting plates on which a plurality of base blocks can be mounted. The bit holder receiving or mounting portion 66 is adapted to receive the shank 16 of the bit holder 10 in the base block bores 36, 72, 74 which is positioned nearly centrally in the bit holder receiving or mounting portion 66. The base block bores 36, 72, 74, 76 axially extend from the top surface 64 of the mounting portion 66 to the rear 84 of the mounting portion 66. The base block bore 36 includes a tapered upper portion 72 (FIGS. 1, 3, and 6), a lower portion 74 (FIGS. 1, 3, 4, 6, and 7) adjacent the upper portion 72, and a distal portion 76 (FIGS. 1 and 3-7) adjacent the lower portion 74. In this embodiment, the upper portion 72 axially extends from the top surface 64 to the lower portion 74, the lower portion 74 axially extends from the upper portion 72 to the distal portion 76, and the distal portion 76 axially extends from the lower portion 74 to the rear 84 of the bit holder receiving portion 66. The lower portion may be cylindrical 78, inwardly tapered 80, or outwardly tapered 82, as shown in FIG. 1. In this illustrated embodiment, the lower portion 74 is cylindrical 78 and the diameter of the lower portion 74 is less than the diameter of the distal portion 76 of the bore 36, as shown in FIGS. 1, 3, and 5.

As long as the cylindrical, inwardly tapered, or outwardly tapered lower portion 50 of the bit holder shank 16 has an increased convergence with the base block bore 36 toward the distal end 34 of the shank 16, many combinations, such as outward tapered shank/cylindrical base block bore, cylindrical shank/inward tapered base block bore, inward tapered base block bore/less inward tapered shank, inward tapered base block bore/outward tapered shank, etc., can be engineered to provide the necessary holding force between the bit holder 10 and the bore 36 of the base block 12. Tapers, resulting in a slidably engageable shank, generally extend from 0.01 degree to 3.5 degrees per side or up to 7 degrees total on a diameter depending on the axial force applied to the bit holder 10 when inserting into the base block 12. In this illustrated embodiment, the lower portion 50 of the shank 16 is outwardly tapered, also termed a reverse taper, and the lower portion 74 of the base block bore 36 is cylindrical, which provides a substantial differential interference fit between the lower portion 50 of the shank 16 and the lower portion 74 of the base block bore 36. This limited difference (differential interference) in substantial annular contact surface between the distal end of the shank 16 and the bottom of the base block bore 36 provides for greater ease of entry and removal of the bit holder 10 from the base block 12 by only having to move the bit holder 10 a short distance in the base block bore 36 to obtain release.

To assemble, the shank 16 of the bit holder 10 is slidably inserted into the bore 36 of the base block 12. The slot 40 allows the shank 16 to radially compress when inserted into the base block bore 36 of the receiving portion 66 forming an interference fit between the shank 16 and the base block bore 36. When fully inserted, the back flange 30 (surface "A" in FIG. 3) of the bit holder 10 seats against the top surface (surface "B" in FIG. 3) of the base block 12, as shown in FIGS. 5 and 6. The force between the diametrically contracted shank 16 and the base block bore 36 maintains and retains the bit holder 10 in the base block 12. The bit (not shown), the bit holder 10, and the base block 12 are assembled together to form a bit assembly (not shown).

As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, "X includes at least one of A and B" is intended to mean any of the natural inclusive permutations. That is, if X includes A; X includes B; or X includes both A and B, then "X includes at least one of A and B" is satisfied under any of the foregoing instances. The articles "a" and "an" as used in this application and the appended claims should generally be construed to mean "one or more" unless specified otherwise or clear from context to be directed to a singular form. Moreover, use of the term "an implementation" or "one implementation" throughout is not intended to mean the same embodiment, aspect or implementation unless described as such.

While the present disclosure has been described in connection with certain embodiments and measurements, it is to be understood that the invention is not to be limited to the disclosed embodiments and measurements but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A bit holder comprising:

a body portion including a bottom;

a generally cylindrical hollow shank axially extending from the bottom of the body portion, the shank comprising:

a slot extending generally axially from a distal end of the shank; and a slidably engageable first segment adjacent the distal end of the shank, the first segment including a first outer surface slideably engageably tapered radially outwardly as the first segment extends from a top of the first segment generally mid-slot toward the distal end of the shank, and the bottom of said body forming a seat to stop slidable engagement of said shank.

2. The bit holder of claim 1, further comprising:

a length of the shank comprising one of a nominal 2¾ and greater than a nominal 1¾ inches.

3. The bit holder of claim 1, further comprising:

a second segment of the shank adjacent the bottom of the body portion, the second segment including a second outer surface tapered radially inwardly toward the distal end of the shank.

4. The bit holder of claim 1, further comprising:

a second segment of the shank adjacent the first segment, the second segment including an upper terminal portion of the slot, the first segment including an increased diameter from the second segment; and a shoulder extending from the first segment to the second segment, the shoulder tapered radially inwardly from the first segment to the second segment.

5. The bit holder of claim 1, further comprising:

a tire portion of the body portion adjacent the bottom of the body portion; and a radially inward outer annular tapered portion of the body portion subjacent the tire portion.

6. The bit holder of claim 5, wherein the radially inward outer annular tapered portion is at about a 45 degree angle to the bottom of the body portion.

7. The bit holder of claim 1, further comprising:

a tire portion of the body portion adjacent the bottom of the body portion, the tire portion including a pair of spatially related parallel undercuts extending inwardly from the bottom of the body portion, the undercuts being a hollow wedge shape, a declining terminus of each undercut ending short of a plane through an axis of the body portion.

8. The bit holder of claim 1, further comprising:

a rounded junction between the bottom of the body portion and a forward end of the shank, the rounded junction adapted to avoid sharp corners and relieve stress cracking.

9. A bit holder comprising:

a body portion including a bottom;

a generally cylindrical hollow shank axially extending from the bottom of the body portion, the shank comprising:

a slot extending generally axially from a distal end of the shank; and a slidably engageable first segment extending adjacent the distal end of the shank generally to a longitudinal position mid-slot, the first segment including an outwardly tapered outer surface.

10. The bit holder of claim 9, further comprising:

a length of the shank comprising one of a nominal 2¾ and greater than a nominal 1¾ inches.

11. The bit holder of claim 9, further comprising:

a second segment of the shank adjacent the bottom of the body portion, the second segment including a second outer surface tapered radially inwardly toward the distal end of the shank.

12. The bit holder of claim 9, further comprising:

a second segment of the shank adjacent the first segment, the second segment including an upper terminal portion of the slot, the first segment including an increased diameter from the second segment; and a shoulder extending from the first segment to the second segment, the shoulder tapered radially inwardly from the first segment to the second segment.

13. The bit holder of claim 9, further comprising:

a tire portion of the body portion adjacent the bottom of the body portion; and a radially inward outer annular tapered portion of the body portion subjacent the tire portion.

14. The bit holder of claim 13, wherein the radially inward outer annular tapered portion is at about a 45 degree angle to the bottom of the body portion.

15. The bit holder of claim 9, further comprising:

a tire portion of the body portion adjacent the bottom of the body portion, the tire portion including a pair of spatially related parallel undercuts extending inwardly from the bottom of the body portion, the undercuts being a hollow wedge shape, a declining terminus of each undercut ending short of a plane through an axis of the body portion.

16. The bit holder of claim 9, further comprising:

a rounded junction between the bottom of the body portion and a forward end of the shank, the rounded junction adapted to avoid sharp corners and relieve stress cracking.

17. A combination bit holder and base block comprising:

the base block comprising:

a base mounting portion including a base surface;

a device receiving portion integrally extending from the base mounting portion opposite the base surface; and a throughbore extending through the device receiving portion, the throughbore including a first portion adjacent a rear of the device receiving portion, the first portion being one of cylindrical, inwardly tapered toward the rear of the device receiving portion, and outwardly tapered toward the rear of the device receiving portion; and the bit holder comprising:

a body portion including a bottom;

a generally cylindrical hollow shank axially extending from the bottom of the body portion, the shank comprising:

a slot extending generally axially from a distal end of the shank;

a slidably engageable first segment adjacent the distal end of the shank, the first segment including an outwardly tapered outer surface, the shank adapted to be inserted into the throughbore of the base block and the first segment adapted to form a differential interference fit with the first portion of the throughbore; and wherein the first segment of the shank includes an outwardly tapered outer surface and the first portion of the throughbore is one of cylindrical and inwardly tapered.

18. The combination bit holder and base block of claim 17, wherein the first segment of the shank includes a cylindrical outer surface and the first portion of the throughbore is inwardly tapered.

19. The bit holder of claim 17, further comprising:

a length of the shank comprising one of a nominal 2¾ and greater than a nominal 1¾ inches.

20. The bit holder of claim 17, further comprising:

a second segment of the shank adjacent the bottom of the body portion, the second segment including a second outer surface tapered radially inwardly toward the distal end of the shank.

21. The bit holder of claim 17, further comprising:

a second segment of the shank adjacent the first segment, the second segment including an upper terminal portion of the slot, the first segment including an increased diameter from the second segment; and a shoulder extending from the first segment to the second segment, the shoulder tapered radially inwardly from the first segment to the second segment.

22. The bit holder of claim 17, further comprising:

a tire portion of the body portion adjacent the bottom of the body portion; and a radially inward outer annular tapered portion of the body portion subjacent the tire portion.

23. The bit holder of claim 22, wherein the radially inward outer annular tapered portion is at about a 45 degree angle to the bottom of the body portion.

24. The bit holder of claim 17, further comprising:

a tire portion of the body portion adjacent the bottom of the body portion, the tire portion including a pair of spatially related parallel undercuts extending inwardly from the bottom of the body portion, the undercuts being a hollow wedge shape, a declining terminus of each undercut ending short of a plane through an axis of the body portion.

25. The bit holder of claim 17, further comprising:

a rounded junction between the bottom of the body portion and a forward end of the shank, the rounded junction adapted to avoid sharp corners and relieve stress cracking.

26. The combination bit holder and base block of claim 17 wherein:

the bit holder shank forms the differential interference fit having increasing interference with the first portion of the through bore toward the distal end of the shank.

* * * * *